United States Patent [19]

Bernhardt

[11] Patent Number: 4,589,167

[45] Date of Patent: May 20, 1986

[54] APPARATUS FOR INTRODUCING A PILE INTO A FOLLOWING ROLLER SYSTEM

[75] Inventor: Siegfried Bernhardt, Bremen, Fed. Rep. of Germany

[73] Assignee: Spinnbau GmbH, Bremen, Fed. Rep. of Germany

[21] Appl. No.: 714,871

[22] Filed: Mar. 22, 1985

[30] Foreign Application Priority Data

Mar. 22, 1984 [DE] Fed. Rep. of Germany ..... 3410443

[51] Int. Cl.[4] ..... D01G 15/46

[52] U.S. Cl. ..... 19/106 R; 19/296

[58] Field of Search ..... 19/106 R, 296

[56] References Cited

U.S. PATENT DOCUMENTS

| | | | |
|---|---|---|---|
| 2,077,095 | 4/1937 | Cady | 19/106 R |
| 2,987,779 | 6/1961 | Kawashima | 19/106 R |
| 3,066,358 | 12/1962 | Schiess | 19/296 X |
| 4,274,178 | 6/1981 | Hotta | 19/106 R |

*Primary Examiner*—Louis K. Rimrodt

*Attorney, Agent, or Firm*—Hill, Van Santen, Steadman & Simpson

[57] ABSTRACT

An apparatus for introducing a relatively loose pile fed from a carder or the like via a conveyor belt or the like into a following roller system, particularly a calender, upon height-reduction of the pile before entry into the roller system, is provided comprising a pile guiding fixture preceding the roller system for compressing the pile while pressing the pile against the conveyor belt.

12 Claims, 3 Drawing Figures

APPARATUS FOR INTRODUCING A PILE INTO A FOLLOWING ROLLER SYSTEM

BACKGROUND OF THE INVENTION

1. Field of the Invention

The invention relates to an apparatus for introducing a relatively loose pile fed from a carder or the like via a conveyor belt or the like into a following roller system, particularly a calender, upon height-reduction of the pile before entry into the roller system.

2. Description of the Prior Art

Upon introduction of a pile which, coming from a carder or the like, is supplied on a conveyor belt to a calender or the like, problems arise as a consequence of the constant increase in the desired working speeds, these problems being based thereon that the pile conducted on the conveyor belt at speeds of more than 60 m/min puffs up immediately before entry into the calender due to air turbulences in running direction, whereby a further increase in the working speed is substantially prevented. Attempts have already been made to counter this problem in that a tensioning slack is established between the conveyor belt and the calender, wherefrom a higher tensioning within the fiber union of the pile can be achieved with, at the same time, a very minimal height reduction of the pile before entry into the calender, however mis-stretching and losses in quality cannot thereby be avoided as a sequel due to occurring irregularities in the pile pattern. The problems described above occur in a particularly serious fashion when it is a matter of greatly re-oriented (crushed) piles such as are increasingly desired by the buyers.

SUMMARY OF THE INVENTION

The object of the invention is to create an apparatus of the type initially cited by means of which the working speed can be clearly increased by improving the introduction of the pile into the roller system and drastic reduction of the puffing tendency to be attributed to air turbulences.

Given an apparatus of the type initially cited this object is achieved in accord with the invention by a pile guiding fixture preceding the roller system for compressing the pile while pressing the pile against the conveyor belt.

It can thereby be provided that the pile guiding fixture comprises at least one pile cylinder rotating in the same direction as the conveyor belt.

It can be further provided in accord with the invention that the surface of the pile guiding cylinder(s) is (are) designed smooth.

It can thereby be further provided that the surface of the pile guiding cylinder(s) is (are) is designed profiled.

Under given conditions, the invention also provides that the pile guiding cylinder(s) is (are) designed as a perforated cylinder.

A further embodiment of the invention provides that the pile guiding fixture comprises at least one printing table or the like moving in the direction toward the roller system in the same direction as the conveyor belt.

It can thereby be provided that the pressing table comprises a circulating screen cloth or the like that is air-permeable.

It can also be provided in accord with the invention that the screen cloth is designed profiled.

The invention thereby also provides under given conditions that the screen cloth is provided with perforations.

Under given conditions, the invention further proposes that the pile guiding cylinder(s) or, respectively, the pressing table(s) is (are) separately driven.

A further development of the invention also provides under given conditions that the pile guiding cylinder(s) or the pressing table(s) is (are) designed entrained.

A further embodiment of the invention is characterized in that the pile guiding fixture comprises at least one spangle plate or the like pressing the pile against the conveyor belt.

It can thereby be provided that the spangle plate is desgined profiled.

It can also be provided in accord with the invention that the spangle plate is designed perforated.

The invention further provides under given conditions that the spangle plate comprises a smooth surface.

A further development of the invention is also characterized under given conditions in that the distance of the pile guiding fixture from the conveyor belt is variable.

As a result of the inventively provided pile guiding fixture by means of which the pile is largely freed of its entrained air by pre-compression with pressing against the conveyor belt before entry into the calender roller system without exerting noticeable pressing powers, one succeeds in keeping the introduction of the pile into the calender free from disturbances occurring in response to air turbulences, etc., even at high working speeds as a consequence of the implemented compression, such disturbances otherwise appearing, particularly given greatly crushed piles, whereby the working speeds can be increased to more than 100 m/min in comparison to hitherto standard values of not more than 60 m/min. Mis-stretching and forfeitures in quality such as were hitherto observed given the presence of a tensioning slack between conveyor belt and calender no longer occur. It should also be noted that particularly those embodiments of the invention have proven themselves wherein the pile guiding fixture, whether it be a pile guiding cylinder or a pressing table as well, has corresponding air extraction devices in the form of perforations having a correspondingly large diameter, etc., available, whereby the pile guiding cylinder can also be executed as a pegged cylinder under given conditions. It is self-understood that a plurality of series-connected pile guiding cylinders and/or pressing tables and/or spangle plates can definitely be provided between carder and calender in order to thus achieve the desired pre-compression of the pile in steps.

BRIEF DESCRIPTION OF THE DRAWINGS

Further features and advantages of the invention derive from the claims and from the following description in which exemplary embodiments are described in detail with reference to the schematic drawing. Thereby shown are:

DESCRIPTION OF THE PREFERRED EMBODIMENTS

Figure 1:
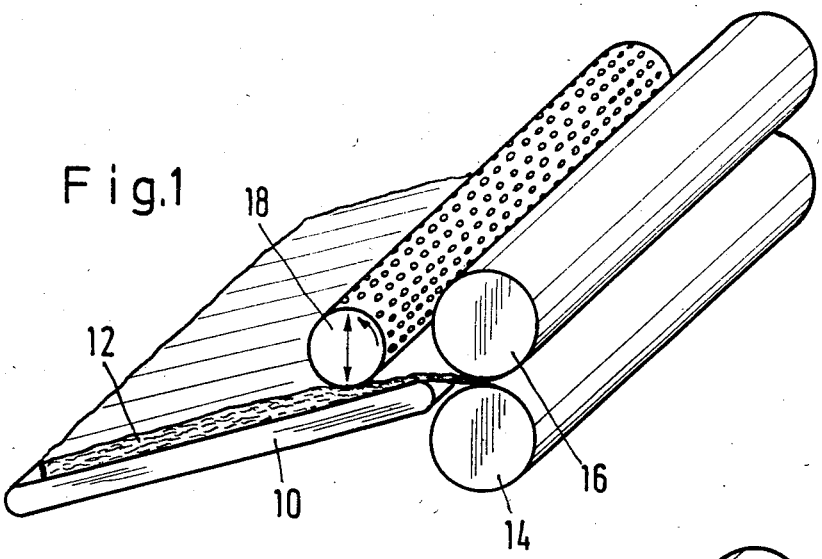
FIG. 1 is a first exemplary embodiment of a pile guiding fixture of the invention in a perspective illustration seen laterally obliquely from the top.

Given the exemplary embodiment shown in FIG. 1, a traditional conveyor belt 10, a pile guiding table or the like, by means of which a relatively loose pile 12 from a carder or the like (not shown in the drawing) disposed to the left of the conveyor belt 10 is supplied to a following roller system composed of two calender rolls 14,16, has a perforated pile guiding cylinder 18 disposed above it, the distance whereof relative to the conveyor belt 10 is variable and by means of which, as may be seen from the drawing, the still relatively loose pile 12 being fed from the carder is so greatly compressed that no air accumulation which could lead to a puffing of the pile and, thus, to an impediment given an increase in the working speed occurs any more given entry of the pile compressed in such fashion into the calender roll system 14,16. The air eliminated from the pile upon compression of the pile 12 by means of the pile guiding cylinder 18 interacting with the conveyor belt 10—this cylinder 18 being designed entrained in the illustrated exemplary embodiment—is carried off through the perforations in the surface of the pile guiding cylinder 18—these perforations being shown in the drawing—into the interior of said cylinder 18 and is subsequently further eliminated into the outside atmosphere. In some use cases, however, it is sufficient to design the surface of the pile guiding cylinder 18 smooth, whereby, of course, a corresponding longitudinal or transverse profiling can also be advantageous.

Figure 2:
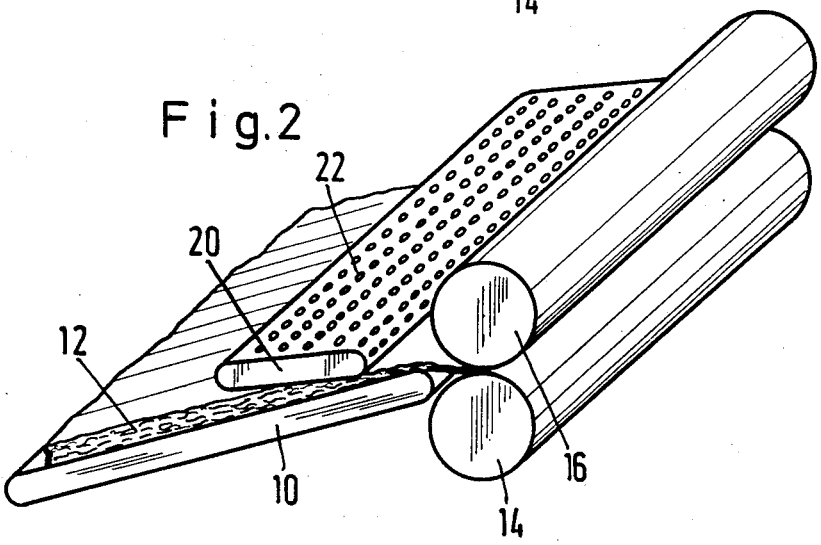
FIG. 2 is a second exemplary embodiment of the invention in a view similar to the illustration in FIG. 1.

Given the exemplary embodiment shown in FIG. 2, the pile guiding fixture of the invention comprises a pressing table 20 instead of the pile guiding cylinders 18 provided in FIG. 1, this pressing table 20 being provided herein with a separate drive and its circulating screen cloth 22 being provided with perforations in order to thus facilitate the elimination of the air expressed from the pile in this fashion.

Figure 3:
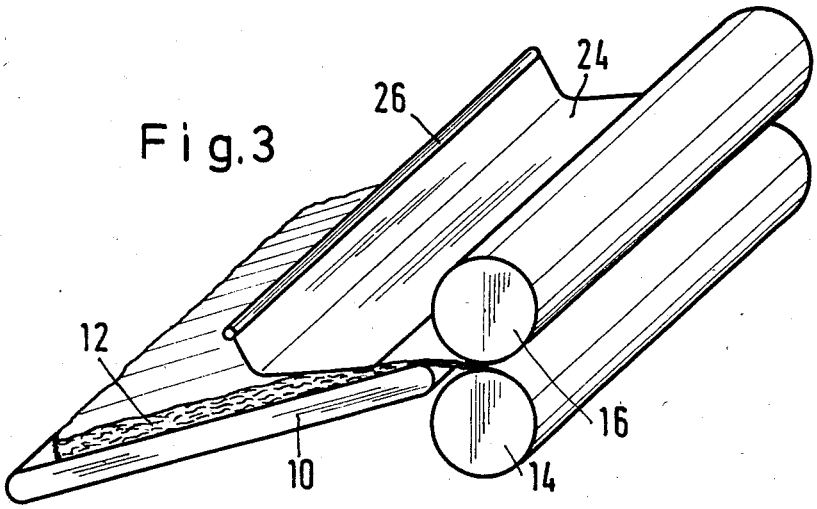
FIG. 3 is a third exemplary embodiment of the invention in a view similar to the illustration in FIGS. 1 and 2.

Given the exemplary embodiment shown in FIG. 3, the inventively provided pile guiding fixture comprises a spangle plate 24 which hangs down onto the pile 12 proceeding from a correspondingly seated retaining rod 26. The spacing of the retaining rod 26, just like, moreover, that of the printing table 20 of FIG. 2, relative to the conveyor belt 10 can be adjusted for varying the throughput gap between the conveyor belt and the pile guiding fixture, so that different degrees of compression of the pile 12 are attainable, whereby it should be noted that a pre-linking of bottom and top pile can also be achieved under given conditions by means of the inventively provided pile guiding fixture.

The features of the invention disclosed in the above description, in the drawing as well as in the claims can be essential both individually as well as in arbitrary combinations for the realization of the invention in its various embodiments.

I claim as my invention:

1. An apparatus for introducing a pile supplied from a carder comb via a conveyor belt into a calender, including a device for reducing the fattening of the pile before entry into the calender, comprising:

a pile compression and guiding device immediately preceding the calender for pressing the pile against the conveyor belt.

2. An apparatus according to claim 1 wherein said pile compression and guiding device comprise at least one rotatable pile guiding drum.

3. An apparatus according to claim 2 wherein said pile guiding drum is fashioned as a perforated drum.

4. An apparatus according to claim 3 wherein said pile guiding drum is driven separately from said calender.

5. An apparatus according to claim 1 wherein said pile compressing and guiding device comprises at least one circulating, endless belt.

6. An apparatus according to claim 5 wherein said endless belt is an air-permeable straining cloth.

7. An apparatus according to claim 6 wherein said straining cloth has a profiled outer surface.

8. An apparatus according to claim 6 wherein said straining cloth is provided with openings.

9. An apparatus according to claim 5 wherein said endless belt is separately driven from said calender.

10. An apparatus according to claim 1 wherein said pile guiding device comprises at least one spangle plate.

11. An apparatus according to claim 10 wherein said spangle plate has openings therethrough.

12. An apparatus according to claim 1 wherein the distance of said pile compressing and guiding device from said conveyor belt is adjustable.

* * * * *